US009905163B2

(12) United States Patent
Hwang et al.

(10) Patent No.: US 9,905,163 B2
(45) Date of Patent: Feb. 27, 2018

(54) ORGANIC LIGHT-EMITTING DISPLAY APPARATUS AND METHOD OF DRIVING THE SAME

(71) Applicant: SAMSUNG DISPLAY CO., LTD., Yongin, Gyeonggi-Do (KR)

(72) Inventors: Youngin Hwang, Yongin (KR); Jihye Kong, Yongin (KR); Yongsung Park, Yongin (KR); Youngjin Cho, Yongin (KR); Inho Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 137 days.

(21) Appl. No.: 14/802,940

(22) Filed: Jul. 17, 2015

(65) Prior Publication Data

US 2016/0232853 A1 Aug. 11, 2016

(30) Foreign Application Priority Data

Feb. 9, 2015 (KR) ..... 10-2015-0019660

(51) Int. Cl.
*G09G 3/30* (2006.01)
*G09G 3/3233* (2016.01)

(52) U.S. Cl.
CPC ... *G09G 3/3233* (2013.01); *G09G 2300/0417* (2013.01); *G09G 2300/0819* (2013.01); *G09G 2300/0861* (2013.01); *G09G 2310/08* (2013.01); *G09G 2320/045* (2013.01)

(58) Field of Classification Search
CPC ..... G09G 3/30–3/3291
See application file for complete search history.

(56) References Cited

U.S. PATENT DOCUMENTS

| | | | | |
|---|---|---|---|---|
| 2007/0091029 | A1* | 4/2007 | Uchino | G09G 3/3233 345/76 |
| 2008/0231199 | A1 | 9/2008 | Yamamoto et al. | |
| 2009/0046088 | A1 | 2/2009 | Asano et al. | |
| 2009/0315815 | A1 | 12/2009 | Woo et al. | |
| 2011/0316892 | A1 | 12/2011 | Sung et al. | |
| 2016/0180770 | A1* | 6/2016 | Duan | G09G 3/3233 345/690 |

FOREIGN PATENT DOCUMENTS

| | | | | |
|---|---|---|---|---|
| CN | 103943067 | A * | 7/2014 | G09G 3/3233 |
| KR | 10-2009-0132858 | A | 12/2009 | |
| KR | 10-2012-0000887 | A | 1/2012 | |

* cited by examiner

*Primary Examiner* — Hang Lin
(74) *Attorney, Agent, or Firm* — Lewis Roca Rothgerber Christie LLP

(57) ABSTRACT

An organic light-emitting display apparatus includes: a pixel coupled to a scan line, a data line, a control line, and a power line, the pixel comprising an organic light-emitting diode configured to emit light in response to a data voltage; and a power supply unit configured to apply power source voltages of different levels during one frame period, wherein the pixel is configured to increase an anode voltage of the organic light-emitting diode in a scan period when the data voltage is inputted.

6 Claims, 25 Drawing Sheets

ORGANIC LIGHT-EMITTING DISPLAY APPARATUS AND METHOD OF DRIVING THE SAME

CROSS-REFERENCE TO RELATED APPLICATION

This application claims priority to and the benefit of Korean Patent Application No. 10-2015-0019660, filed on Feb. 9, 2015, in the Korean Intellectual Property Office, the entire content of which is incorporated herein by reference.

BACKGROUND

1. Field

Aspects of example embodiments of the present invention relate to an organic light-emitting display apparatus and a method of driving the same.

2. Description of the Related Art

Display apparatuses, particularly, organic light-emitting display apparatuses, display an image via an organic light-emitting diode that emits light due to a recombination of electrons and holes and have a relatively fast response speed and low power consumption.

An organic light-emitting display apparatus (e.g., an active matrix-type organic light-emitting display apparatus) includes a plurality of scan lines, a plurality of data lines, a plurality of power lines, and a plurality of pixels coupled to the lines and arranged in a matrix arrangement.

Each of the plurality of pixels emits light of a predetermined brightness in response to a data signal. However, the organic light-emitting display apparatus may not display an image of a desired brightness due to non-uniformity of threshold voltages of transistors included in each of the plurality of pixels and changes in electron mobility.

The above information disclosed in this Background section is only for enhancement of understanding of the background of the invention and therefore it may contain information that does not constitute prior art.

SUMMARY

One or more example embodiments include an organic light-emitting display apparatus and a driving method thereof.

Additional aspects will be set forth in part in the description which follows and, in part, will be apparent from the description, or may be learned by practice of the presented embodiments.

According to one or more example embodiments, an organic light-emitting display apparatus includes: a pixel coupled to a scan line, a data line, a control line, and a power line, the pixel comprising an organic light-emitting diode configured to emit light in response to a data voltage; and a power supply unit configured to apply power source voltages of different levels during one frame period, wherein the pixel is configured to increase an anode voltage of the organic light-emitting diode in a scan period when the data voltage is inputted.

The pixel may include: a first transistor between a first power source and a driving transistor and configured to turn on in response to an emission control signal; a second transistor between the data line and a first node and configured to turn on in response to a first scan signal; a third transistor between the first power source and the driving transistor and configured to turn on in response to a second scan signal; a fourth transistor between one end of each of the first and third transistors and a second node, wherein the fourth transistor is configured to supply a driving current to the organic light-emitting diode based on the data voltage, wherein the fourth transistor is the driving transistor; and a storage capacitor between the first node and the second node, wherein an anode electrode of the organic light-emitting diode is coupled to the second node, and a cathode electrode of the organic light-emitting diode is coupled to a second power source.

The anode voltage may be formed based on an auxiliary voltage, a low voltage, and the data voltage supplied through the data line when the second transistor is turned on, a threshold voltage of the fourth transistor, and a compensation voltage generated based on a first power source voltage generated by the first power source when the third transistor is turned on in the scan period.

The first and second scan signals may be consecutive scan signals and a portion of the first scan signal overlaps a portion of the second scan signal.

The first and second scan signals may be a same signal.

According to one or more example embodiments, in a method of driving an organic light-emitting display apparatus comprising: a pixel coupled to a scan line, a data line, a control line, and a power line and comprising an organic light-emitting diode and a driving transistor configured to supply a driving current to the organic light-emitting diode based on a scan signal and a data signal, the method comprising: an initialization operation of initializing a voltage applied to a gate electrode of the driving transistor; a threshold voltage adjusting operation of adjusting a threshold voltage of the driving transistor; a scan operation of applying a data voltage to the gate electrode and increasing an anode voltage of the organic light-emitting diode; and an emission operation of emitting light from the organic light-emitting diode of a brightness corresponding to the data voltage.

In the scan operation, the pixel may be driven via a first scan signal and a second scan signal following the first scan signal, and a portion of the first scan signal overlaps a portion of the second scan signal.

In the scan operation, the anode voltage may increase by a compensation voltage generated based on a first power source voltage.

The pixel may further include a storage capacitor between the gate electrode and an anode electrode of the organic light-emitting diode, wherein the method further includes: a scan preparation operation of applying a low voltage to the gate electrode and decreasing the anode voltage of the organic light-emitting diode, and in the scan preparation operation, a parasitic capacitor of the organic light-emitting diode decreases the anode voltage by a value obtained by sharing with the storage capacitor a voltage difference between an auxiliary voltage applied to the gate electrode in the initialization operation and the low voltage.

In the scan operation, a parasitic capacitor may increase the anode voltage by a value obtained by sharing with the storage capacitor a voltage difference between the data voltage and the low voltage.

BRIEF DESCRIPTION OF THE DRAWINGS

These and/or other aspects will become apparent and more readily appreciated from the following description of the example embodiments, taken in conjunction with the accompanying drawings in which.

DETAILED DESCRIPTION

Figure 1:
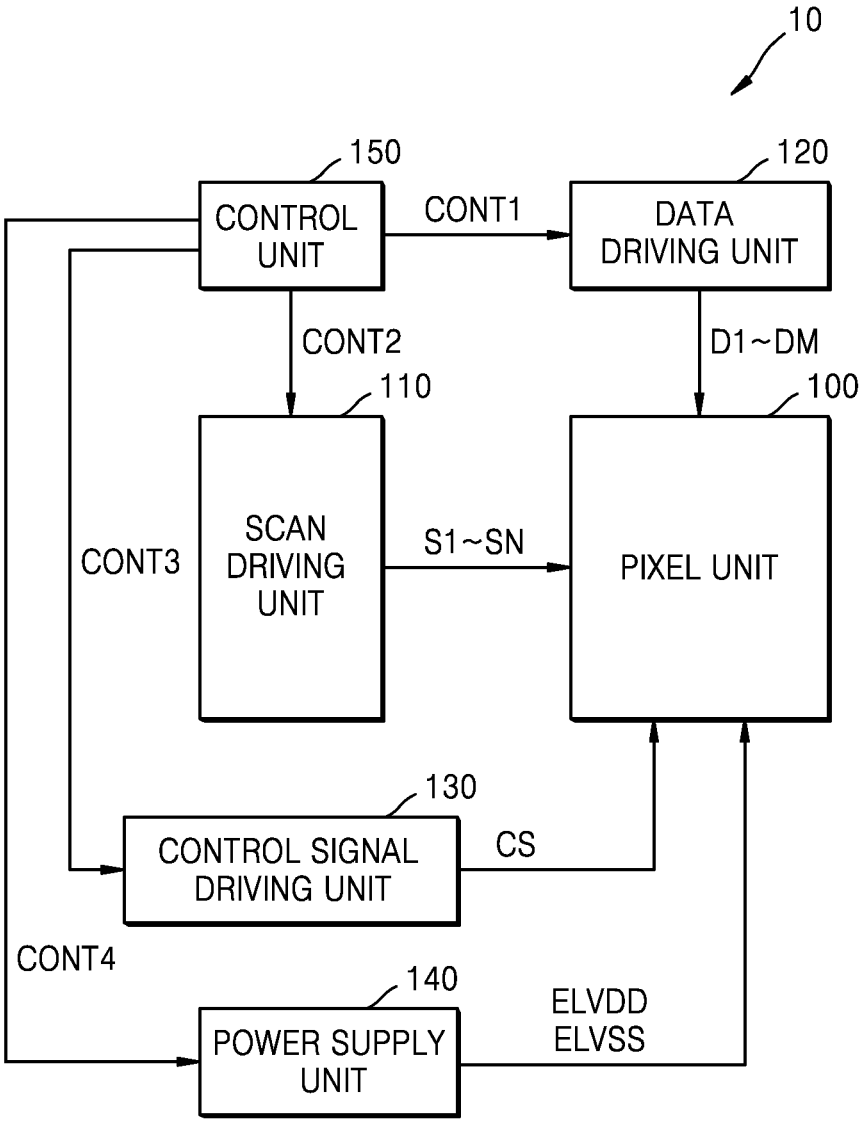
FIG. 1 illustrates a block diagram of an organic light-emitting display apparatus, according example embodiments of the present invention.

Reference will now be made in some detail to example embodiments, examples of which are illustrated in the accompanying drawings, wherein like reference numerals refer to like elements throughout. In this regard, the present example embodiments may have different forms and should not be construed as being limited to the descriptions set forth herein. Accordingly, the example embodiments are merely described below, by referring to the figures, to explain some aspects of embodiments of the present invention.

It will be understood that although the terms "first", "second", etc. may be used herein to describe various components, these components should not be limited by these terms. These components are only used to distinguish one component from another.

As used herein, the singular forms "a," "an," and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

It will be understood that when a layer, region, or component is referred to as being "formed on," another layer, region, or component, it can be directly or indirectly formed on the other layer, region, or component. That is, for example, intervening layers, regions, or components may be present.

Sizes of elements in the drawings may be exaggerated for convenience of explanation. In other words, because sizes and thicknesses of components in the drawings are illustrated for convenience of explanation, the following embodiments are not limited thereto.

As used herein, expressions such as "at least one of," when preceding a list of elements, modify the entire list of elements and do not modify the individual elements of the list.

FIG. 1 illustrates a block diagram of an organic light-emitting display apparatus 10 according to an example embodiment of the present invention.

Referring to FIG. 1, the organic light-emitting display apparatus 10 includes a pixel unit 100, a scan driving unit 110, a data driving unit 120, a control signal driving unit 130, a power supply unit 140, and a control unit 150.

The pixel unit 100 includes a plurality of scan lines, a plurality of data lines, and a plurality of pixels. The plurality of scan lines are spaced apart from each other (e.g., with a constant interval) and are arranged in a row and deliver data signals D1 to DM, respectively. The plurality of scan lines and the plurality of data lines are arranged in a matrix arrangement, wherein a pixel is formed at each crossing point. The pixel unit 100 may further include a plurality of control lines. The plurality of control lines are spaced apart from each other (e.g., with a constant interval) and are arranged in a row, and each of the plurality of control lines delivers a control signal CS. Each control line may include at least one of an emission control line, an initialization control line, and a relay control line for respectively delivering an emission control signal GC, an initialization control signal SUS, and a relay control signal GW.

The scan driving unit 110 is coupled to the plurality of scan lines of the pixel unit 100 and applies scan signals S1 to SN formed by a combination of a gate-on voltage and a gate-off voltage to the scan lines, respectively, in response to a second control signal CONT2. When one of the scan signals S1 to SN has the gate-on voltage, a switching transistor of a pixel connected to the corresponding scan line is turned on.

The data driving unit 120 is coupled to the plurality of data lines of the pixel unit 100 and applies the data signals D1 to DM indicating a gray level to the data lines, respectively, in response to a first control signal CONT1. The data driving unit 120 converts input image data having a gray level, which is inputted from the control unit 150, into a voltage- or current-type data signal.

The control signal driving unit 130 is coupled to the plurality of control lines of the pixel unit 100 and applies the control signal CS to the control lines in response to a third control signal CONT3. The control signal driving unit 130 may be coupled to a plurality of emission control lines to generate the emission control signal GC and to supply the emission control signal GC to the plurality of emission control lines. The control signal driving unit 130 may be coupled to a plurality of initialization control lines to generate the initialization control signal SUS and to supply the initialization control signal SUS to the plurality of initialization control lines. The control signal driving unit 130 may be coupled to a plurality of relay control lines to generate the relay control signal GW and to supply the relay control signal GW to the plurality of relay control lines.

The power supply unit 140 generates a first power source voltage ELVDD and a second power source voltage ELVSS. The power supply unit 140 applies the generated first and second power source voltages ELVDD and ELVSS to the pixel unit 100 in response to a fourth control signal CONT4. A voltage level of the first power source voltage ELVDD is higher than a voltage level of the second power source voltage ELVSS. For example, the first power source voltage ELVDD may be 13 V, and the second power source voltage ELVSS may be 5 V. The power supply unit 140 may apply power source voltages of different levels to a pixel for one frame period.

The control unit 150 receives input image data and an input control signal for controlling display of the input image data from an external graphic controller. The input control signal includes, for example, a vertical synchronization signal Vsync, a horizontal synchronization signal Hsync, and a main clock MCLK. The control unit 150 generates the data signals D1-DM and the first to fourth control signals CONT1, CONT2, CONT3, and CONT4 according to the vertical synchronization signal Vsync, the horizontal synchronization signal Hsync, and the main clock MCLK. The control unit 150 delivers the data signals D1-DM and the first control signal CONT1 to the data driving unit 120. The control unit 150 generates the second control signal CONT2 and delivers the second control signal CONT2 to the scan driving unit 110. The control unit 150 generates the third control signal CONT3 and delivers the third control signal CONT3 to the control signal driving unit 130. The control unit 150 generates the fourth control signal CONT4 and delivers the fourth control signal CONT4 to the power supply unit 140.

The scan driving unit 110, the data driving unit 120, the control signal driving unit 130, the power supply unit 140, and the control unit 150 may be formed in an arrangement or configuration of individual integrated circuit chips or one integrated circuit chip and may be directly mounted on a substrate on which the pixel unit 100 is formed, mounted on a flexible printed circuit film, attached to the substrate in a form of a tape carrier package (TCP), or directly formed on the substrate.

Figure 2:
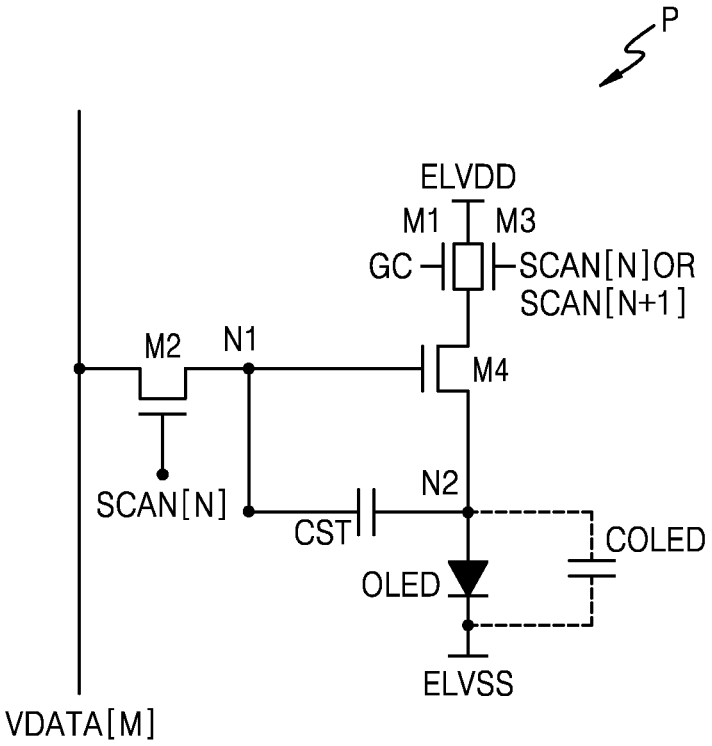
FIG. 2 illustrates a circuit diagram of a pixel in an organic light-emitting display apparatus, according example embodiments of the present invention.

FIG. 2 illustrates a circuit diagram of a pixel P in the organic light-emitting display apparatus 10, according to an example embodiment of the present invention.

Referring to FIG. 2, the pixel P in the organic light-emitting display apparatus 10, according to an example embodiment of the present invention, includes an organic light-emitting diode OLED and a pixel circuit for supplying a current to the organic light-emitting diode OLED. For convenience of description, it is assumed that the pixel P shown in FIG. 2 is coupled to an Nth scan line and an Mth data line.

The pixel circuit for supplying a current to the organic light-emitting diode OLED includes first to fourth transistors M1 to M4 and a storage capacitor CST.

According to one or more embodiments of the present invention, a first electrode may be a drain electrode or a source electrode of a transistor, and a second electrode may be the source electrode or the drain electrode of the transistor. This may be commonly applied to first electrodes and second electrodes of transistors to be described below.

The first power source voltage ELVDD is applied to a first electrode of the first transistor M1, and a second electrode of the first transistor M1 is connected to a driving transistor (the fourth transistor M4). When the emission control signal GC is supplied to the first transistor M1, the first transistor M1 is turned on and applies the first power source voltage ELVDD to the driving transistor.

A first electrode of the second transistor M2 is connected to a data line VDATA[M], and a second electrode of the second transistor M2 is coupled to a first node N1. When an Nth scan signal SCAN[N] is supplied to the second transistor M2, the second transistor M2 is turned on and electrically couples the data line VDATA[M] and the first node N1.

The first power source voltage ELVDD is applied to a first electrode of the third transistor M3, and a second electrode of the third transistor M3 is coupled to the driving transistor. When the first scan signal SCAN[N] or an (N+1)th scan signal SCAN[N+1] is supplied to the third transistor M3, the third transistor M3 is turned on and applies the first power source voltage ELVDD to the driving transistor. The third transistor M3 may be coupled in parallel to the first transistor M1.

A gate electrode of the fourth transistor M4 is coupled to the first node N1, a first electrode of the fourth transistor M4 is coupled to one end of each of the first and third transistors M1 and M3, and a second electrode of the fourth transistor M4 is coupled to a second node N2. The third transistor M3 supplies a driving current to the organic light-emitting diode OLED based on a data voltage applied for one frame period.

One end of the storage capacitor CST is coupled to the first node N1, and the other end thereof is coupled to the second node N2.

An anode electrode of the organic light-emitting diode OLED is coupled to the second node N2, and the second power source voltage ELVSS is applied to a cathode electrode of the organic light-emitting diode OLED. The organic light-emitting diode OLED may emit light (e.g., of a predetermined brightness) in correspondence with the current supplied from the pixel circuit.

Figure 3:
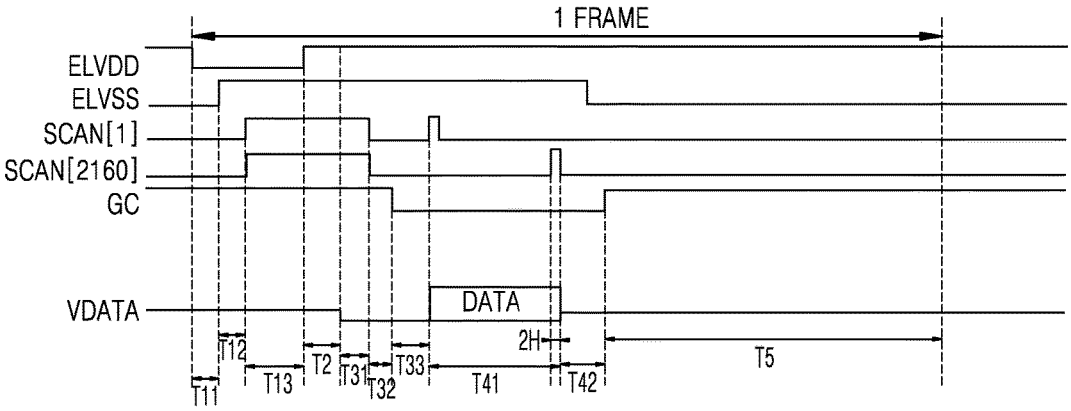
FIG. 3 illustrates a driving timing diagram of a pixel in an organic light-emitting display apparatus, according example embodiments of the present invention.

FIG. 3 illustrates a driving timing diagram of a pixel in an organic light-emitting display apparatus, according to an example embodiment of the present invention.

Referring to FIG. 3, according to a simultaneous emission method according to an example embodiment of the present invention, one frame period includes a scan period in which data signals are respectively written to the whole pixels and an emission period in which each of the whole pixels emits light according to each corresponding written data signal after the data signals are written to the whole pixels.

That is, the organic light-emitting display apparatus according to an example embodiment of the present invention may be driven by the simultaneous emission method in which the whole pixels emit light at the same time after a data signal is sequentially written for each pixel.

For example, one frame for driving the organic light-emitting display apparatus according to an example embodiment of the present invention may include an initialization operation T11 to T13, a threshold voltage compensation operation T2, a scan preparation operation T31 to T33, a scan operation T41 and T42, and an emission operation T5. The one frame may include, for example, 3912 horizontal times.

According to an example embodiment of the present invention, the scan operation T41 and T42 is sequentially performed for each scan line, but the initialization operation T11 to T13, the threshold voltage compensation operation T2, the scan preparation operation T31 to T33, and the emission operation T5 are performed at the same time for the entire pixel unit 100 as shown in FIG. 3.

The initialization operation T11 to T13 is an operation of initializing a driving voltage applied to an organic light-emitting diode of each pixel of the pixel unit 100. When a cathode electrode of the organic light-emitting diode is fixed to a constant voltage, an anode voltage of the organic light-emitting diode in the initialization operation T11 to T13 may be the first power source voltage ELVDD of a low level (e.g., 0 V).

According to an example embodiment of the present invention, to block a leakage current, a cathode voltage of the organic light-emitting diode in the initialization operation T11 to T13 may be set to a higher voltage level than the anode voltage. By setting the cathode voltage of the organic light-emitting diode than to a higher voltage level than the anode voltage in the initialization operation T11 to T13, the organic light-emitting diode may be prevented from emitting light when mobility is compensated for.

In the initialization operation T11 to T13, a voltage applied to a gate electrode of a driving transistor may be initialized to a voltage of a low level, e.g., 2 V, supplied through a data line.

For example, a first initialization operation T11 may be maintained for 10 horizontal times, a second initialization operation T12 may be maintained for 10 horizontal times, and a third initialization operation T13 may be maintained for 30 horizontal times.

The threshold voltage compensation operation T2 is an operation of compensating for a threshold voltage of the driving transistor included in the pixel.

For example, the threshold voltage compensation operation T2 may be maintained for 150 horizontal times.

The scan preparation operation T31 to T33 is an operation of applying a voltage (e.g., a predetermined voltage) to an anode electrode of the organic light-emitting diode after compensating for the threshold voltage. According to an example embodiment of the present invention, when a low voltage lower than an auxiliary voltage is applied to the gate electrode of the driving transistor in the scan preparation operation T31 to T33, the anode voltage of the organic light-emitting diode may decrease in proportion to a difference between the auxiliary voltage and the low voltage.

For example, a first scan preparation operation T31 may be maintained for 10 horizontal times, a second scan preparation operation T32 may be maintained for 10 horizontal times, and a third scan preparation operation T33 may be maintained for 20 horizontal times.

The scan operation T41 and T42 is an operation of sequentially writing a data signal for each scan line. According to an example embodiment of the present invention, in the scan operation T41 and T42, both data writing and driving transistor mobility compensation are performed. For example, when a data voltage higher than the low voltage is inputted to the gate electrode of the driving transistor in the scan operation T41 and T42, the anode voltage of the organic light-emitting diode may increase in proportion to a difference between the data voltage and the low voltage.

According to an example embodiment of the present invention, the Nth scan signal SCAN[N] may be applied to both the gate electrode of the second transistor M2 for inputting a data signal and the gate electrode of the third transistor M3 for applying the first power source voltage ELVDD to the driving transistor M4.

According to another example embodiment of the present invention, the Nth scan signal SCAN[N] may be applied to the gate electrode of the second transistor M2 for inputting a data signal, and the (N+1)th scan signal SCAN[N+1] may be applied to the gate electrode of the third transistor M3 for applying the first power source voltage ELVDD to the driving transistor M4. In this case, scan signals may be applied such that a width of each scan signal is two horizontal times 2H and widths of adjacent scan signals (e.g., a width of the Nth scan signal SCAN[N] and a width of the (N+1)th scan signal SCAN[N+1]) overlap by one horizontal time 1H. The mobility compensation of the driving transistor may be performed by the scan signal overlapping.

For example, a first scan operation T41 may be maintained for 2159 horizontal times, and a second scan operation T42 may be maintained for 20 horizontal times.

The emission operation T5 is an operation in which the whole pixels simultaneously emit light of a brightness corresponding to a current outputted by each driving transistor.

For example, the emission operation T5 may be maintained for 1571 horizontal times.

Signals applied to the initialization operation T11 to T13, the threshold voltage compensation operation T2, the scan preparation operation T31 to T33, and the emission operation T5 according to an example embodiment of the present invention (e.g., the scan signals S1 to SN applied to the plurality of scan lines, the first power source voltage ELVDD applied to each of the plurality of pixels, and a plurality of emission control signals GC respectively applied to the plurality of emission control lines, may be applied to the plurality of pixels at a voltage level (e.g., a predetermined voltage level) at the same time).

Driving an organic light-emitting display apparatus by a simultaneous emission method according to an example embodiment of the present invention will now be described in more detail with reference to FIGS. 6 to 24.

FIGS. 4, 6, 8, 10, 12, 14, 16, 18, 21, and 23 illustrate circuit diagrams of the pixel P to explain pixel driving for each driving operation of an organic light-emitting display apparatus, according to an example embodiment of the present invention, and FIGS. 5, 7, 9, 11, 13, 15, 17, 19, 20, 22, and 24 illustrate driving timing diagrams of the pixel P to explain pixel driving for each driving operation of the organic light-emitting display apparatus, according to an example embodiment of the present invention.

Although a voltage level of each signal is illustrated as a specific numeric value for convenience of description, this is only an arbitrary value for understanding and does not indicate an actual design value.

FIGS. 4 to 9 illustrate circuit diagrams and driving timing diagrams for explaining pixel driving in the initialization operation T11 to T13 of the organic light-emitting display apparatus, according to an example embodiment of the present invention.

Figure 4:
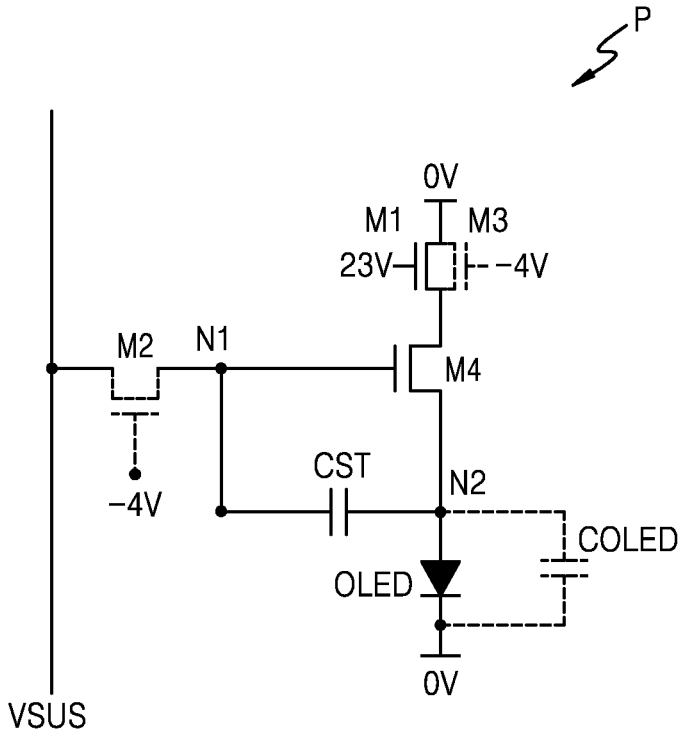
FIGS. 4, 6, 8, 10, 12, 14, 16, 18, 21, and 23 illustrate circuit diagrams of a pixel to explain pixel driving for each driving operation of an organic light-emitting display apparatus, according example embodiments of the present invention.
Figure 5:
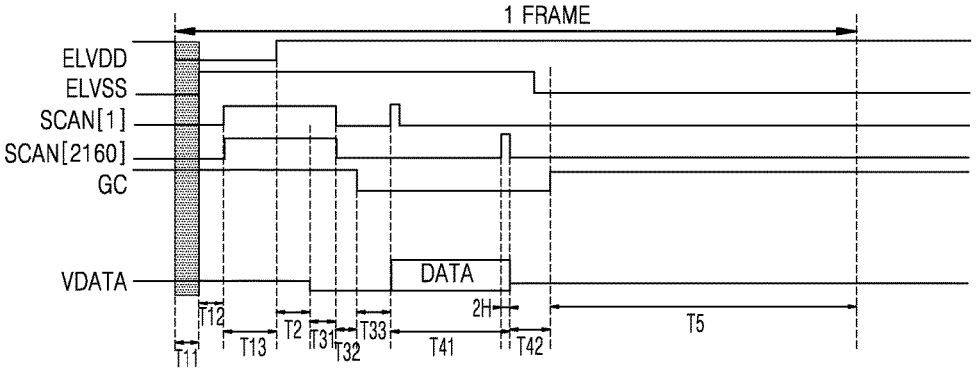
FIGS. 5, 7, 9, 11, 13, 15, 17, 19, 20, 22, and 24 illustrate driving timing diagrams of the pixel to explain pixel driving for each driving operation of the organic light-emitting display apparatus, according example embodiments of the present invention.

Referring to FIGS. 4 and 5, in the first initialization operation T11, each of the first power source voltage ELVDD and the second power source voltage ELVSS may be a low level (e.g., 0 V).

Figure 6:
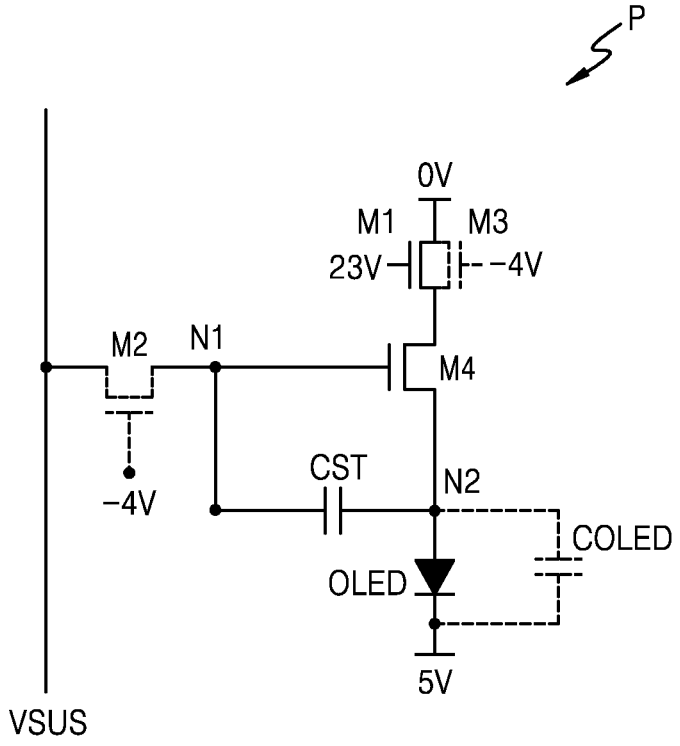
Figure 7:
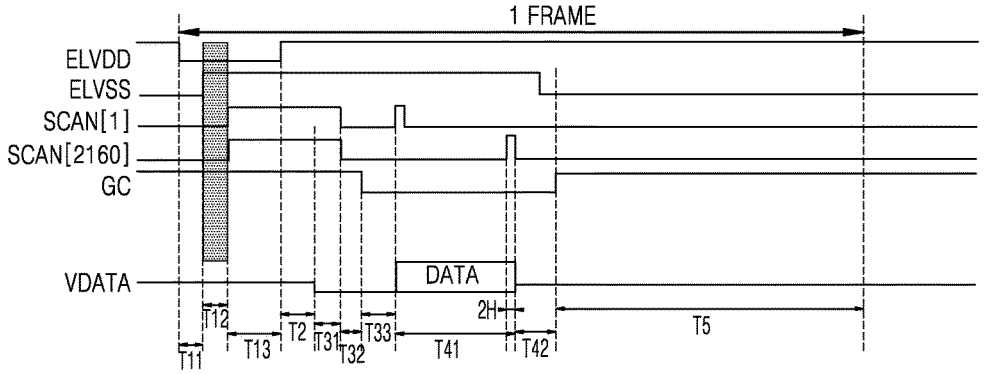

Referring to FIGS. 6 and 7, in the second initialization operation T12, the second power source voltage ELVSS may be a high level (e.g., 5 V). As a result, the cathode voltage of the organic light-emitting diode OLED is set to a higher level than the anode voltage thereof, thereby preventing emission of the organic light-emitting diode OLED.

In the first and second initialization operations T11 and T12, the second to fourth transistors M2 to M4 of the pixel P are turned off.

Figure 8:
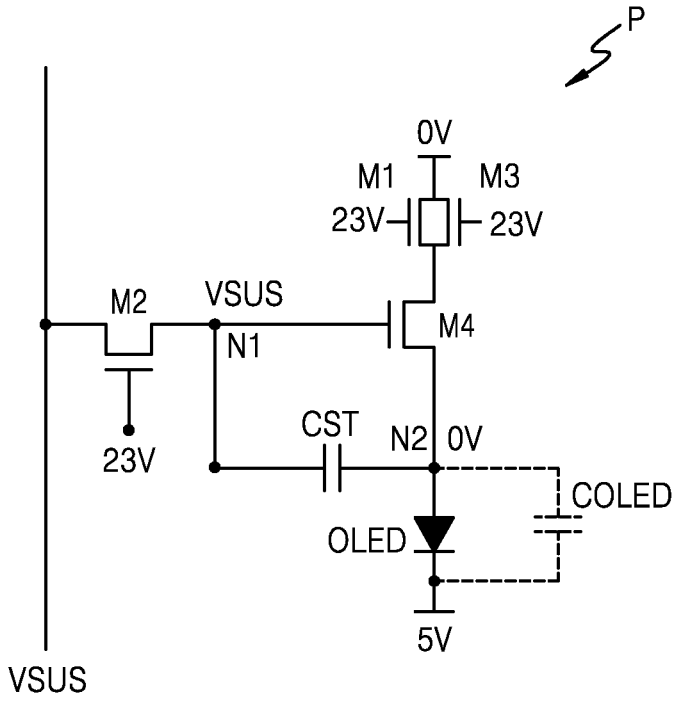
Figure 9:
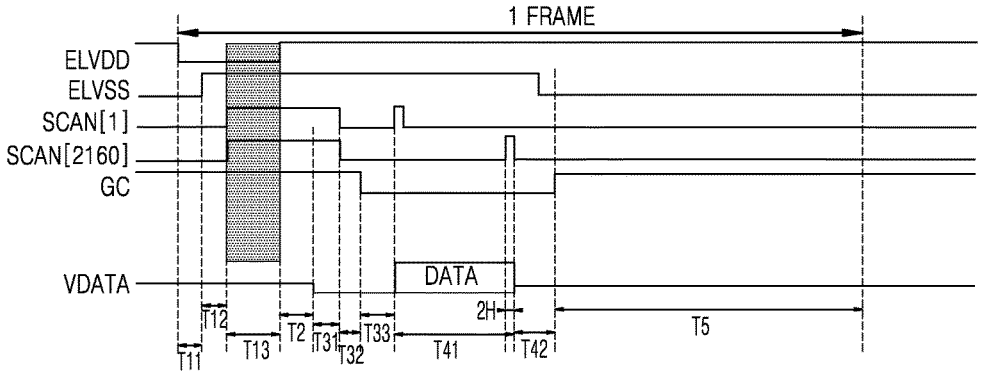

Referring to FIGS. 8 and 9, in the third initialization operation T13, the first to fourth transistors M1 to M4 of the pixel P are turned on. Along with the turn-on of the fourth transistor M4, the first power source voltage ELVDD of, for example, 0 V, is applied to the second node N2, and 0 V is applied to the anode electrode of the organic light-emitting diode OLED coupled to the second node N2. As a result, charges charged in the anode electrode of the organic light-emitting diode OLED are discharged due to the voltage of 0 V, thereby initializing the driving voltage of the organic light-emitting diode OLED.

In the third initialization operation T13, along with the turn-on of the second transistor M2, the data line VDATA [M] and the first node N1 are electrically coupled to each other. In the third initialization operation T13, an auxiliary voltage VSUS is supplied through the data line VDATA[M] and is applied to the first node N1. The auxiliary voltage VSUS may be higher than a low voltage VLOW and lower than a data voltage VDATA (e.g., 2 V).

Figure 10:
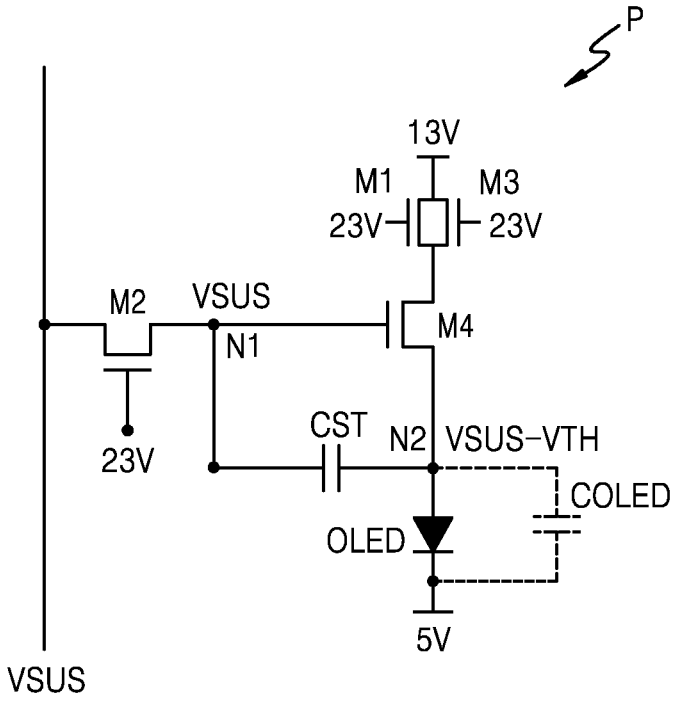
Figure 11:
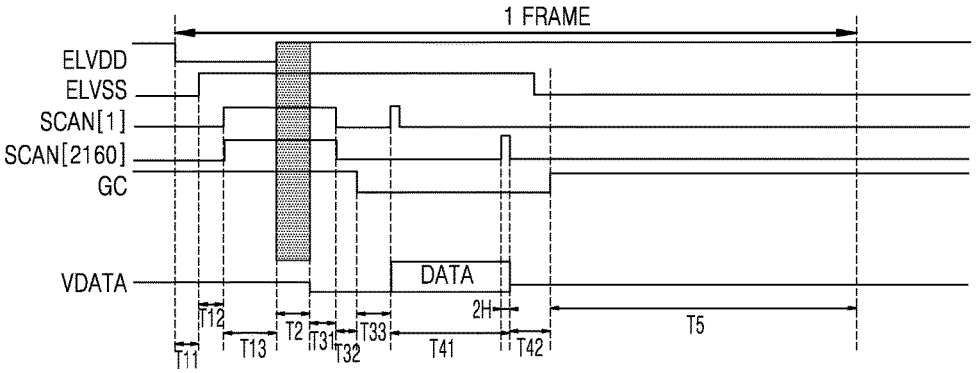

Referring to FIGS. 10 and 11, in the threshold voltage compensation operation T2, the first power source voltage ELVDD may be a high level (e.g., 13 V). Along with the turn-on of the first to third transistors M1 to M3, the auxiliary voltage VSUS of 2 V may be applied to the gate electrode of the fourth transistor M4 that is the driving transistor, 13 V may be applied to a drain electrode of the fourth transistor M4, and 0 V may be applied to a source electrode of the fourth transistor M4. As a result, the fourth transistor M4 is turned on, and a difference (VSUS−VTH) between the gate voltage and a threshold voltage VTH is applied to the second node N2. In this case, because the cathode voltage of the organic light-emitting diode OLED is fixed to 5 V which is a higher level than the difference (VSUS−VTH) between the gate voltage and the threshold voltage VTH, no current flows through the organic light-emitting diode OLED.

In the threshold voltage compensation operation T2, a voltage corresponding to the threshold voltage VTH of the fourth transistor M4 may be charged to the storage capacitor CST of which both ends are respectively coupled to the first and second nodes N1 and N2 (e.g., the gate and source electrode of the fourth transistor M4). As such, by storing the threshold voltage VTH of the driving transistor in the storage capacitor CST in the threshold voltage compensation operation T2, abnormality due to a threshold voltage deviation of the driving transistor may be removed when a data voltage is applied to the pixel P thereafter.

Figure 12:
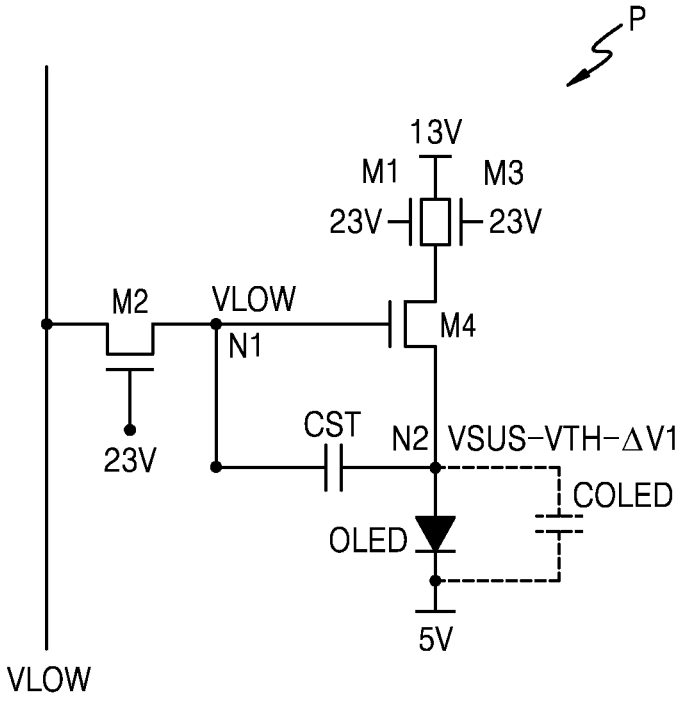
Figure 13:
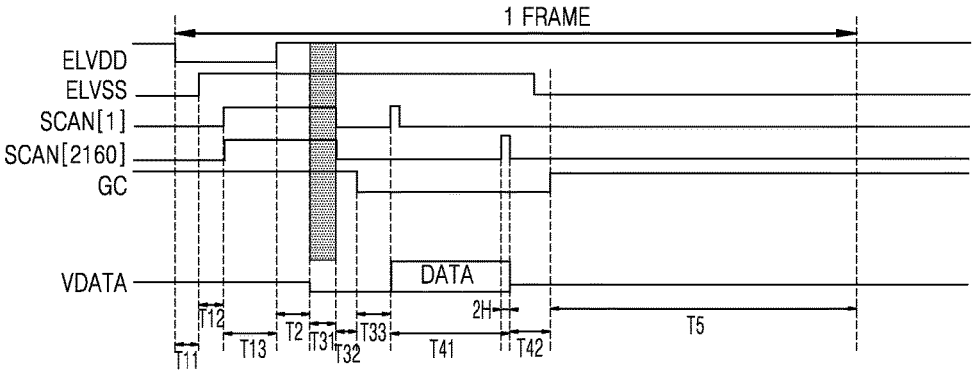

Referring to FIGS. 12 and 13, in the first scan preparation operation T31, the low voltage VLOW is supplied through the data line VDATA[M] and is applied to the first node N1, and the threshold voltage compensation is stopped from being applied.

In the first scan preparation operation T31, assuming that the second power source voltage ELVSS of a constant level (or substantially constant level) is supplied, a voltage applied to the second node N2 changes in correspondence with a change in a voltage applied to the first node N1.

Along with a decrease in the voltage applied to the first node N1 from the auxiliary voltage VSUS to the low voltage VLOW, a voltage decreased by a first change voltage ΔV1 represented by Equation 1, below, is further applied to the second node N2.

$$\Delta V1 = \frac{CST \times (VSUS - VLOW)}{CST + COLED} \quad (1)$$

As shown in Equation 1, the first change voltage ΔV1 is a voltage of a parasitic capacitor COLED of the organic light-emitting diode OLED, which is obtained by sharing, with the storage capacitor CST, a difference (VSUS−VLOW) between the auxiliary voltage VSUS and the low voltage VLOW, which is applied to the first node N1.

Therefore, a final voltage applied to the second node N2 in the first scan preparation operation T31 becomes a difference (VSUS−VTH−ΔV1) among the auxiliary voltage VSUS, the threshold voltage VTH of the driving transistor, and the first change voltage ΔV1.

Figure 14:
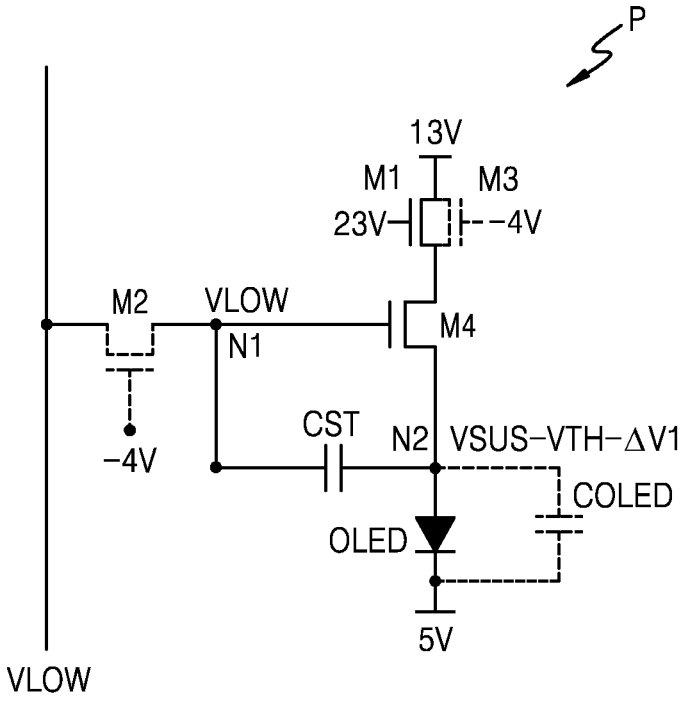
Figure 15:
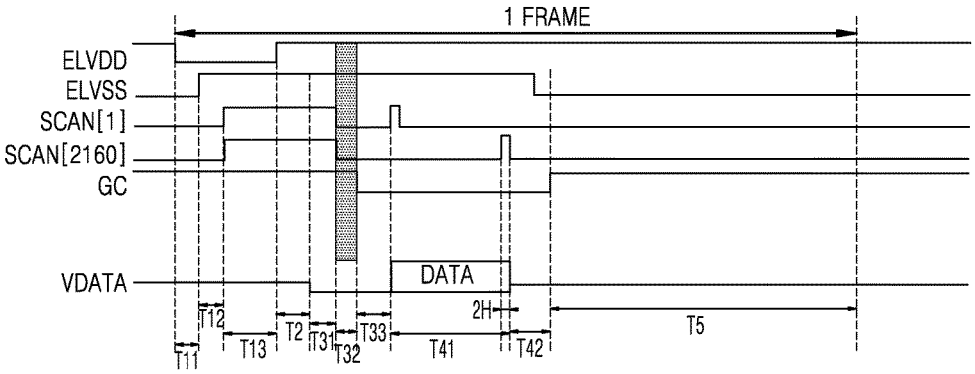

Referring to FIGS. 14 and 15, in the second scan preparation operation T32, the second and third transistors M2 and M3 are turned off.

A voltage applied to the second node N2 in the second scan preparation operation T32 is maintained as the difference (VSUS−VTH−ΔV1) among the auxiliary voltage VSUS, the threshold voltage VTH of the driving transistor, and the first change voltage ΔV1.

Figure 16:
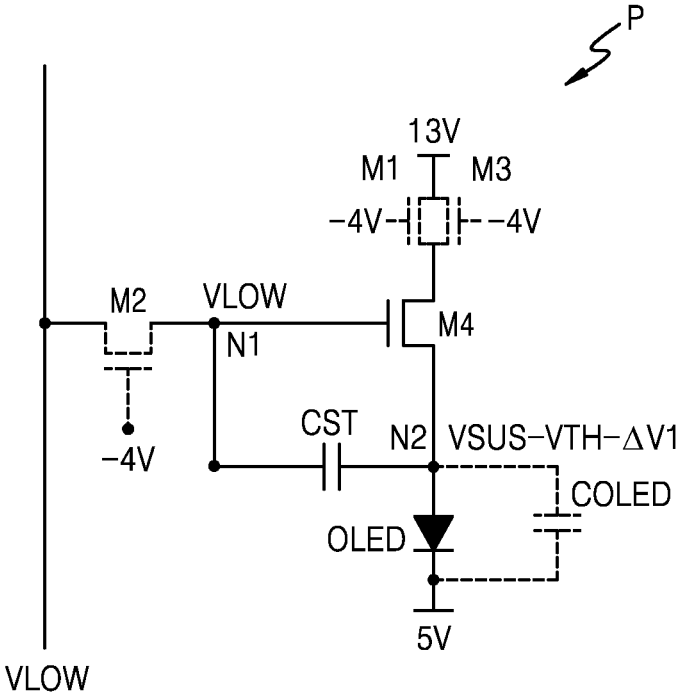
Figure 17:
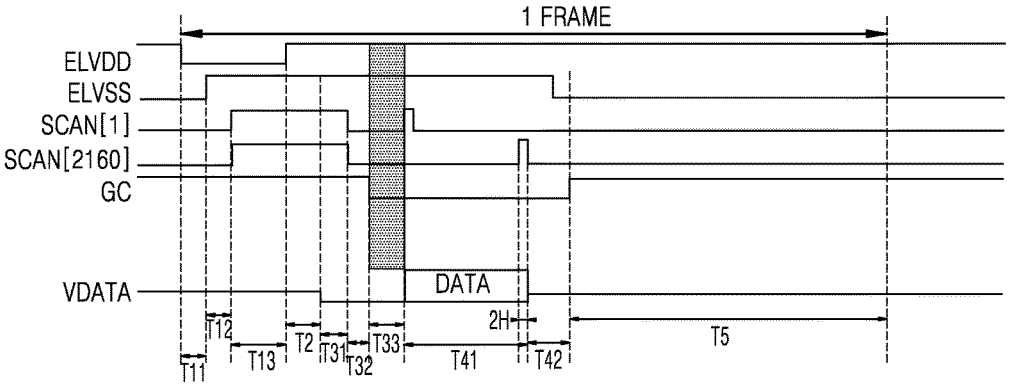

Referring to FIGS. 16 and 17, in the third scan preparation operation T33, the first transistor is turned off.

A voltage applied to the second node N2 in the third scan preparation operation T33 is maintained as the difference (VSUS−VTH−ΔV1) among the auxiliary voltage VSUS, the threshold voltage VTH of the driving transistor, and the first change voltage ΔV1.

As described above, in the scan preparation operation T31 to T33, along with a decrease in the voltage applied to the first node N1, a voltage applied to the second node N2 decreases.

Figure 18:
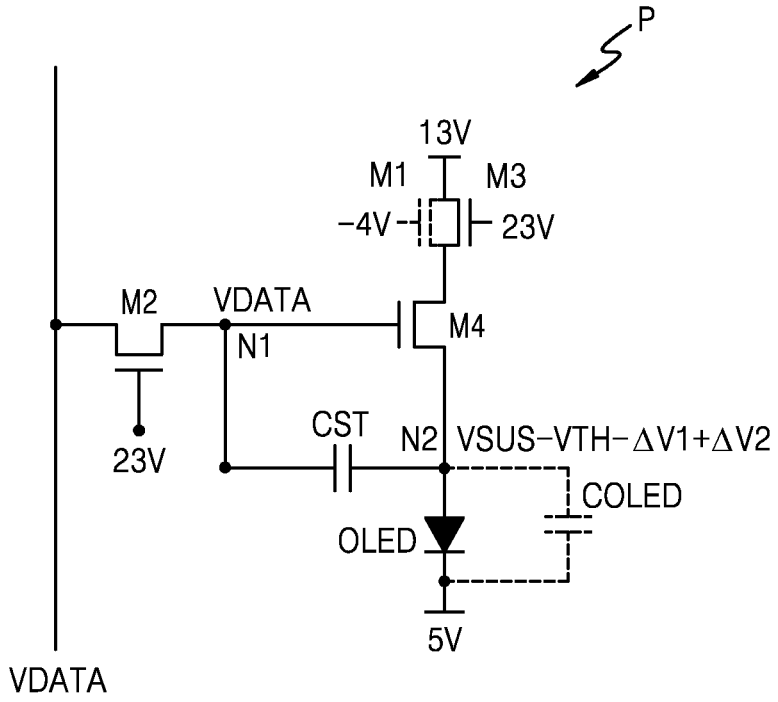
Figure 19:
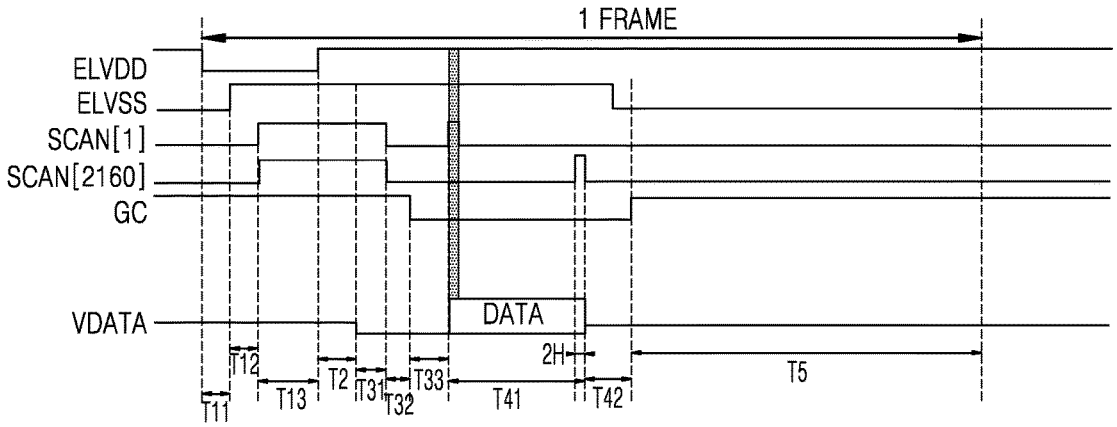

Referring to FIGS. 18 and 19, in the first scan operation T41, the scan signals S1 to SN are applied to the plurality of scan lines, respectively, and the data signals D1 to DM are applied to the plurality of data lines, respectively.

That is, in the first scan operation T41, a scan signal is sequentially applied to each scan line, and in response to the scan signal, a data signal is sequentially applied to the pixel P coupled to each scan line. For example, in the first scan operation T41, when the Nth scan signal SCAN[N] having a voltage level of 23 V is applied to a gate voltage of the second transistor M2, a data voltage VDATA of 9 V is applied to the first node N1.

Along with an increase of the voltage applied to the first node N1 from the low voltage VLOW to the data voltage VDATA, a voltage increased by a second change voltage ΔV2 represented by Equation 2, below, is further applied to the second node N2.

$$\Delta V2 = \frac{CST \times (VDATA - VLOW)}{CST + COLED} + \alpha \quad (2)$$

As shown in Equation 2, the second change voltage ΔV2 is a voltage obtained by adding a voltage of the parasitic capacitor COLED of the organic light-emitting diode OLED, which is obtained by sharing, with the storage capacitor CST, a difference (VDATA−VLOW) between the data voltage VDATA and the low voltage VLOW, which is applied to the first node N1, and a compensation voltage α generated based on the first power source voltage ELVDD.

The compensation voltage α may be generated due to a current flowing through the organic light-emitting diode OLED via the fourth transistor M4 along with the turn-on of the third transistor M3 in the first scan operation T41. The compensation voltage α may compensate for the mobility of the driving transistor.

Therefore, a final voltage applied to the second node N2 in the first scan operation T41 becomes a voltage (VSUS−VTH−ΔV1+ΔV2) obtained by adding the second change voltage ΔV2 to the difference (VSUS−VTH−ΔV1) among the auxiliary voltage VSUS, the threshold voltage VTH of the driving transistor, and the first change voltage ΔV1.

Figure 20:
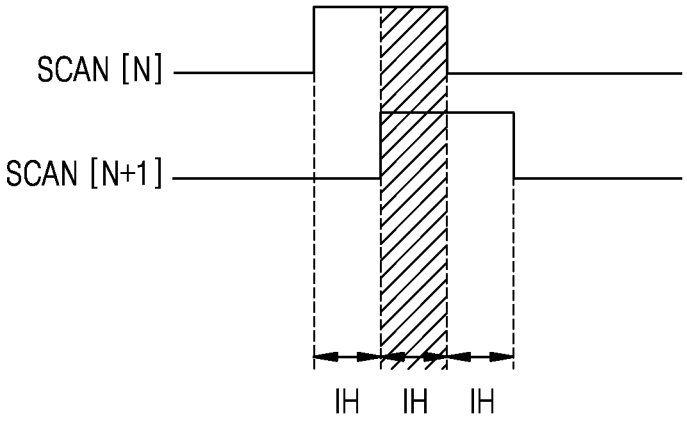

According to an example embodiment of the present invention, as shown in FIG. 20, a width of each sequentially applied scan signal may be 2 horizontal times 2H. For example, the Nth scan signal SCAN[N] and the (N+1)th scan signal SCAN[N+1] may be applied such that a width of the Nth scan signal SCAN[N] overlaps by one horizontal time 1H with a width of the (N+1)th scan signal SCAN[N+1].

Figure 21:
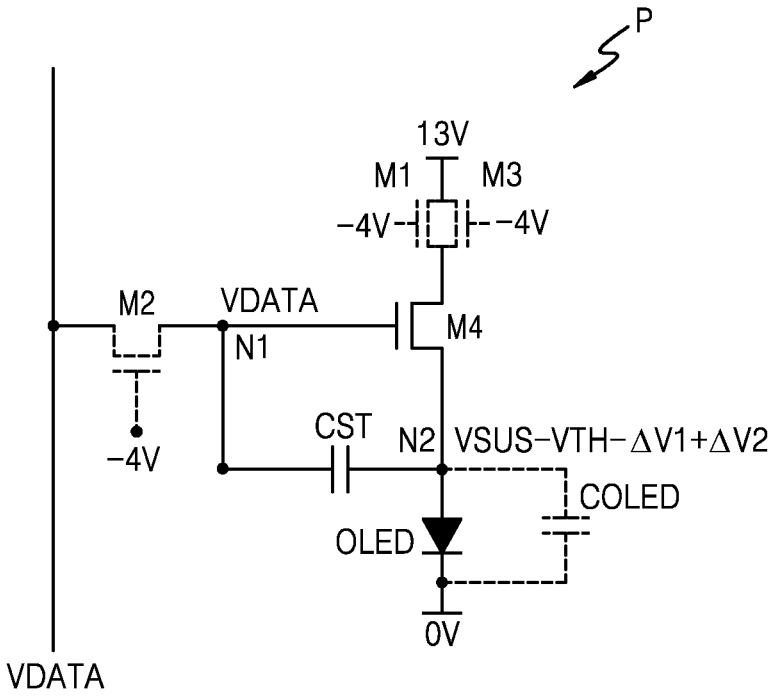
Figure 22:
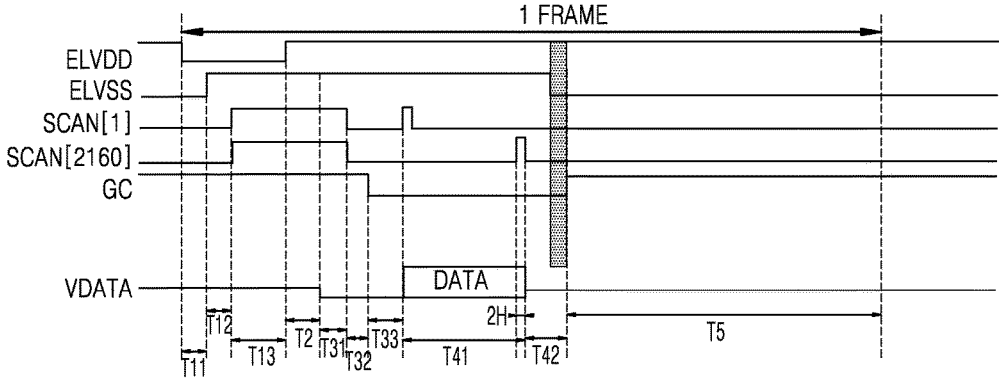

Referring to FIGS. 21 and 22, in the second scan operation T42, the first to third transistors M1 to M3 are turned off, and the second power source voltage ELVSS of a low level (e.g., 0 V) is supplied.

In the second scan operation T42, a voltage applied to the second node N2 is maintained as the voltage (VSUS−VTH−ΔV1+ΔV2) obtained by adding the second change voltage ΔV2 to the difference (VSUS−VTH−ΔV1) among the auxiliary voltage VSUS, the threshold voltage VTH of the driving transistor, and the first change voltage ΔV1.

Figure 23:
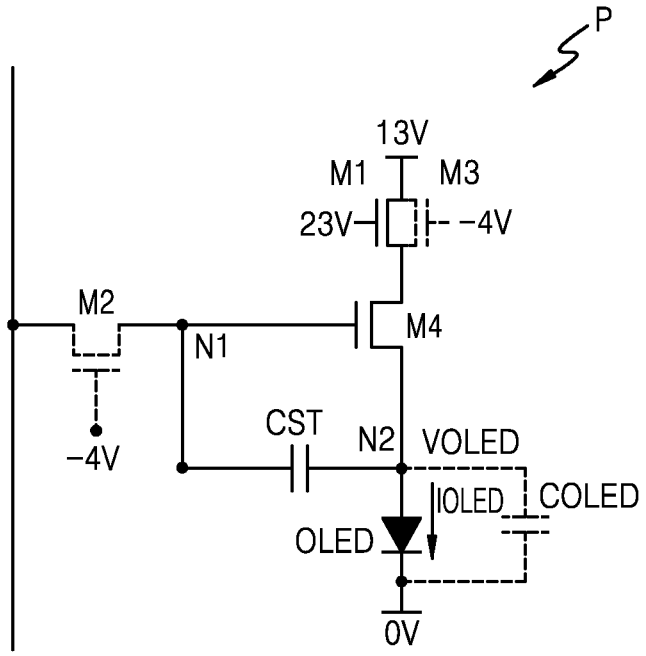
Figure 24:
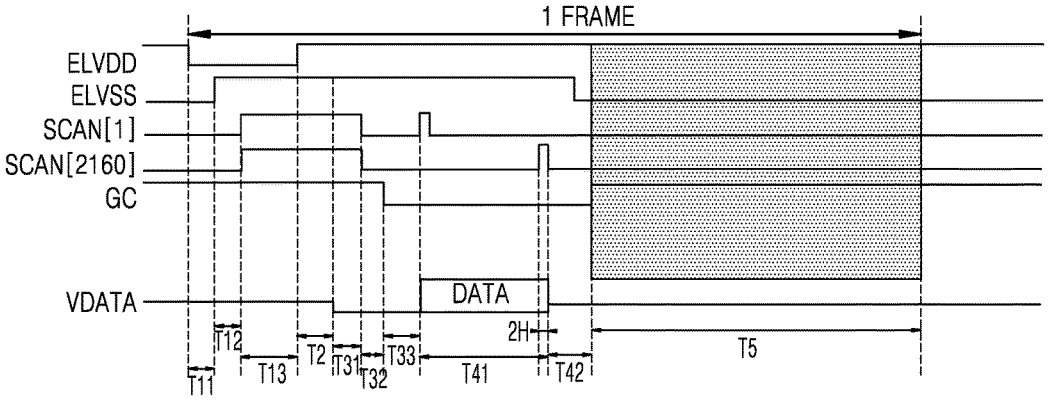

Referring to FIGS. 23 and 24, in the emission operation T5, the first transistor M1 is turned on, the first power source voltage ELVDD of 13 V is supplied, and the second power source voltage ELVSS of 0 V is supplied, and thus a driving current flows through the organic light-emitting diode OLED via the fourth transistor M4.

In the emission operation T5, a voltage represented by Equations 3 and 4 is applied to the first node N1. The voltage applied to the first node N1 is the same as a gate voltage VG of the driving transistor.

$$VG = VDATA + \frac{CST \times [VOLED - (VSUS - VTH - \Delta V1 + \Delta V2)]}{CST + \frac{2}{3} \times COX} \quad (3)$$

$$VG \approx VDATA + [VOLED - (VSUS - VTH - \Delta V1 + \Delta V2)](CST >> \mathrm{COX}) \quad (4)$$

COX denotes a capacitance that may be obtained from the driving transistor towards the organic light-emitting diode OLED and has a very smaller value than a capacitance of the storage capacitor CST.

Therefore, a current IOLED flowing through the organic light-emitting diode OLED is represented by Equation 5.

$$IOLED = \frac{1}{2}\mu COX \frac{W}{L}(VDATA - VSUS + \Delta V1 - \Delta V2)^2 \quad (5)$$

According to the above-described example embodiments of the present invention, the threshold voltage and the mobility of the driving transistor may be compensated for. An effect according to the above-described example embodiments will now be described with reference to FIGS. 25A and 25B.

Figure 25A:
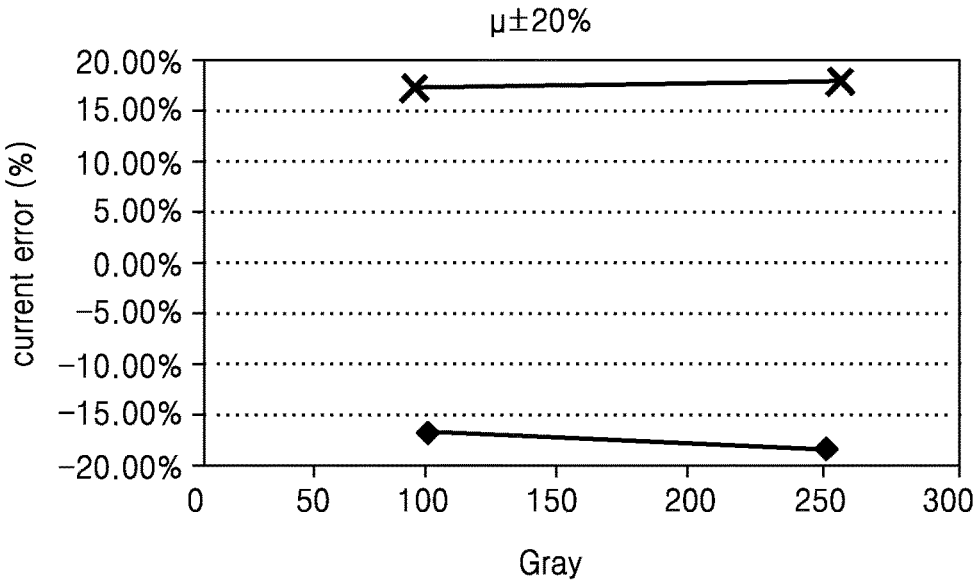
FIGS. 25A and 25B illustrate graphs for explaining deviation compensation for each gray level of an organic light-emitting display apparatus, according example embodiments of the present invention.
Figure 25B:
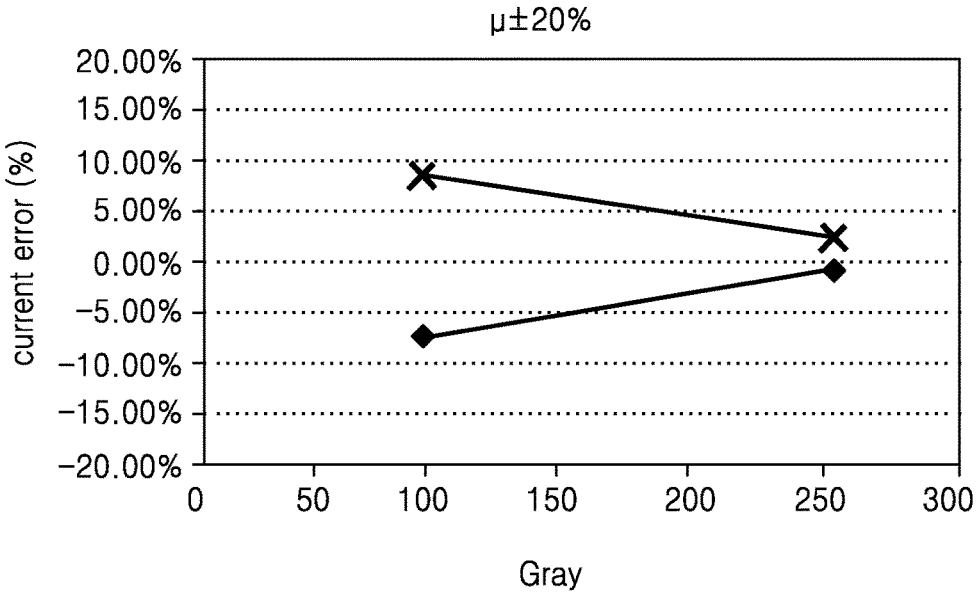

FIGS. 25A and 25B illustrate graphs for explaining deviation compensation for each gray level of an organic light-emitting display apparatus, according to an example embodiment of the present invention.

Referring to FIG. 25A, according to the related art, because mobility is not compensated for, an error of a current flowing through an organic light-emitting diode increases as a gray level increases.

Referring to FIG. 25B, according to the example embodiments of the present invention, because a mobility of a driving transistor is adjusted before an emission operation, an error of a current flowing through an organic light-emitting diode decreases as a gray level increases.

As described above, according to the one or more of the above example embodiments, an organic light-emitting display apparatus may display an image having a desired brightness.

It should be understood that the example embodiments described therein should be considered in a descriptive sense only and not for purposes of limitation. Descriptions of features or aspects within each example embodiment should typically be considered as available for other similar features or aspects in other example embodiments.

While one or more example embodiments have been described with reference to the figures, it will be understood by those of ordinary skill in the art that various changes in form and details may be made therein without departing from the spirit and scope as defined by the following claims, and their equivalents.

What is claimed is:

1. An organic light-emitting display apparatus comprising:

a pixel coupled to a scan line, a data line, a control line, and a power line, the pixel comprising an organic light-emitting diode configured to emit light in response to a data voltage; and a power supply unit configured to apply power source voltages of different levels during one frame period, wherein the pixel is configured to increase an anode voltage of the organic light-emitting diode in a scan period when the data voltage is inputted, wherein the pixel comprises:

a first transistor between a first power source and a driving transistor and configured to turn on in response to an emission control signal;

a second transistor between the data line and a first node and configured to turn on in response to a first scan signal;

a third transistor between the first power source and the driving transistor and configured to turn on in response to a second scan signal;

a fourth transistor between one end of each of the first and third transistors and a second node, wherein the fourth transistor is configured to supply a driving current to the organic light-emitting diode based on the data voltage, wherein the fourth transistor is the driving transistor; and a storage capacitor between the first node and the second node, wherein an anode electrode of the organic light-emitting diode is coupled to the second node, and a cathode electrode of the organic light-emitting diode is coupled to a second power source, wherein the first and second scan signals are a same signal.

2. The organic light-emitting display apparatus of claim 1, wherein the anode voltage is formed based on an auxiliary voltage, a low voltage, and the data voltage supplied through the data line when the second transistor is turned on, a threshold voltage of the fourth transistor, and a compensation voltage generated based on a first power source voltage generated by the first power source when the third transistor is turned on in the scan period.

3. A method of driving an organic light-emitting display apparatus comprising:

a pixel coupled to a scan line, a data line, a control line, and a power line and comprising an organic light-emitting diode and a driving transistor configured to supply a driving current to the organic light-emitting diode based on a scan signal and a data signal, the method comprising:

an initialization operation of initializing a voltage applied to a gate electrode of the driving transistor;

a threshold voltage adjusting operation of adjusting a threshold voltage of the driving transistor;

a scan operation of applying a data voltage to the gate electrode and increasing an anode voltage of the organic light-emitting diode; and an emission operation of emitting light from the organic light-emitting diode of a brightness corresponding to the data voltage, wherein the pixel further comprises a storage capacitor between the gate electrode and an anode electrode of the organic light-emitting diode, wherein the method further comprises:

a scan preparation operation of applying a low voltage to the gate electrode and decreasing the anode voltage of the organic light-emitting diode, and in the scan preparation operation, a parasitic capacitor of the organic light-emitting diode decreases the anode voltage by a value obtained by sharing with the storage capacitor a voltage difference between an auxiliary voltage applied to the gate electrode in the initialization operation and the low voltage.

4. The method of claim 3, wherein in the scan operation, the pixel is driven via a first scan signal and a second scan signal following the first scan signal, and a portion of the first scan signal overlaps a portion of the second scan signal.

5. The method of claim 3, wherein in the scan operation, the anode voltage increases by a compensation voltage generated based on a first power source voltage.

6. The method of claim 3, wherein in the scan operation, a parasitic capacitor increases the anode voltage by a value obtained by sharing with the storage capacitor a voltage difference between the data voltage and the low voltage.

* * * * *